United States Patent [19]

Barowitz et al.

[11] 4,223,304

[45] * Sep. 16, 1980

[54] VIBRATION RESPONSIVE INTRUDER ALARM SYSTEMS

[75] Inventors: Peter J. Barowitz, Welwin; Roy Baxendale, Harpenden, both of England

[73] Assignee: Elliott Brothers (London) Limited, Chelmsford, England

[ * ] Notice: The portion of the term of this patent subsequent to May 16, 1995, has been disclaimed.

[21] Appl. No.: 898,901

[22] Filed: Apr. 21, 1978

Related U.S. Application Data

[63] Continuation-in-part of Ser. No. 776,438, Mar. 11, 1977, abandoned.

[30] Foreign Application Priority Data

Mar. 16, 1976 [GB] United Kingdom ..... 10493/76

[51] Int. Cl.[2] ..... G08B 13/22

[52] U.S. Cl. ..... 340/566

[58] Field of Search ..... 340/566

[56] References Cited

U.S. PATENT DOCUMENTS

| | | | |
|---|---|---|---|
| 3,614,724 | 10/1971 | Brown et al. | 340/566 |
| 3,665,445 | 5/1972 | Riley, Jr. | 340/566 |
| 3,903,512 | 9/1975 | Laymon | 340/566 |
| 4,090,180 | 5/1978 | Barowitz et al. | 340/566 |

*Primary Examiner*—Glen R. Swann, III

*Attorney, Agent, or Firm*—Kirschstein, Kirschstein, Ottinger & Cobrin

[57] ABSTRACT

Electric signals in two narrow frequency bands, centered on thirty-three and one hundred Hertz, arising from ground or airborne vibrations incident on one or more geophones are processed to give an alarm when signal components in the two bands exhibiting a rapid rise to greater than a predetermined amplitude level, characteristic of human footsteps within a protected area, occur at more than a predetermined repetition rate.

7 Claims, 4 Drawing Figures

VIBRATION RESPONSIVE INTRUDER ALARM SYSTEMS

CROSS-REFERENCE TO RELATED APPLICATION

This application is a continuation-in-part of application Ser. No. 776,438 filed Mar. 11, 1977 for "INTRUDER ALARM SYSTEMS", now abandoned.

BACKGROUND OF THE INVENTION

1. Field of the Invention

Intruder alarm systems.

2. Description of the Prior Art

In intruder alarm systems in which acoustic or other vibrations arising fron the movements of an intruder within a protected area are sensed by one or more electromechanical transducers which provide electric signals from which an alarm condition may be recognised, it is necessary reliably to distinguish vibrations caused by a human intruder from those from other sources such as rain or hail, small animals, tree roots or nearby road, rail or air traffic, so as to avoid too many false alarms.

SUMMARY OF THE INVENTION

1. Purposes of the Invention

According to one aspect of the present invention an intruder alarm system comprises one or more electromechanical transducers that provide electric signals in response to vibrations incident upon said one or more transducers, which electric signals may extend over a range of frequencies, bandpass filter means to pass electric signal components in a band of frequencies within said range, means to rectify said signal components to provide a first electric waveform, means to derive from the first electric waveform a second electric waveform which tends to follow said first waveform but with slowed rise times, and detector means to compare the first and second electric waveforms and to give a signal from which an alarm indication may be derived if said first waveform exceeds said second waveform in magnitude by more than a predetermined amount.

According to another aspect of the present invention an intruder alarm system comprises one or more electromechanical transducers that provide electric signals in response to vibrations incident upon said one or more transducers, which electric signals may extend over a range of frequencies, first and second bandpass filter means to pass signal components in respective bands of frequencies within said range, respective means to rectify said signal components to provide first and second electric waveforms, detector circuit means to give an output signal if a respective one of said electric waveforms exceeds a respective reference signal by more than a predetermined amount, comparator means to compare time integrals of said first and second waveforms and gating means to pass or block the output signal from said detector circuit in dependence upon an output from said comparator means.

2. Brief Description of the Invention

Preferably there are provided two detector circuit means arranged to receive respective ones of said first and second electric waveforms and to provide respective output signals, and said gating means is arranged to pass or block the output signal from one of said detector circuits in dependence upon said output from said comparator means and the output signal from the other of said detector circuits.

BRIEF DESCRIPTION OF THE DRAWINGS

An intruder alarm system in accordance with the present invention will now be described by way of example with reference to the accompanying drawings, of which.

PREFERRED EMBODIMENTS OF THE INVENTION

Figure 1:
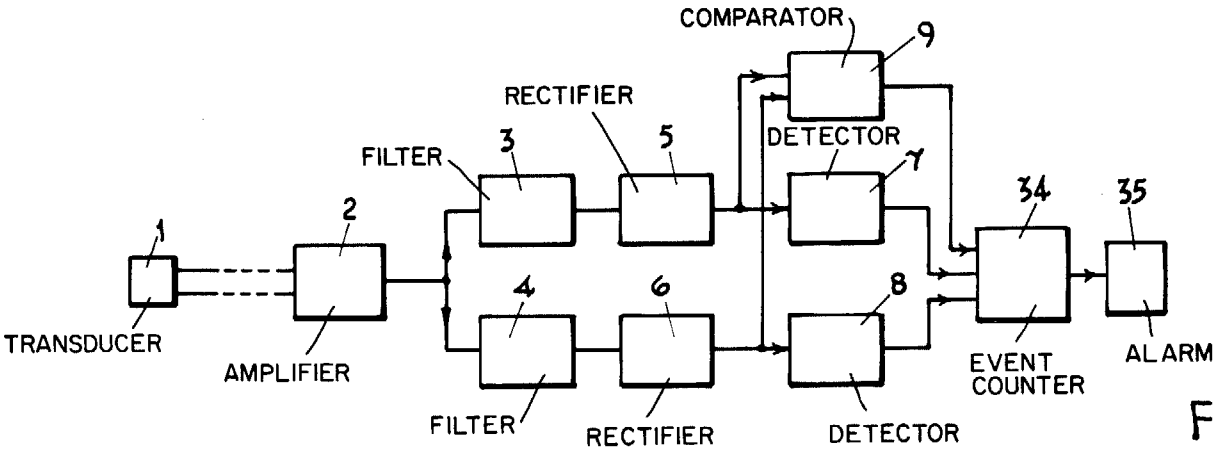
FIG. 1 shows the system schematically.

Referring first to FIG. 1 the intruder alarm system comprises one or more electromechanical transducers, represented by the block 1, which are arranged to provide electric signals in response to mechanical or acoustic vibrations incident upon said transducers. The transducers 1, sometimes known as geophones, may be attached to posts or walls or buried in the ground within the area to be protected by the alarm system, and may be connected either in common or individually to broadband amplifiers represented by the block 2.

In response to footsteps or other causes of ground-borne or acoustic vibrations within or near the protected area the transducers 1 receive vibrations, and derive analogous electric signals, extending over a range of frequencies, the signals of interest for intruder detection ranging from say fifteen to one hundred and fifty Hertz. The electric signals, after amplification, are applied to two narrow-band filters 3 and 4 having passbands some thirtyseven and twelve Hertz wide respectively centred on one hundred Hertz and thirty three Hertz respectively.

Figure 2:
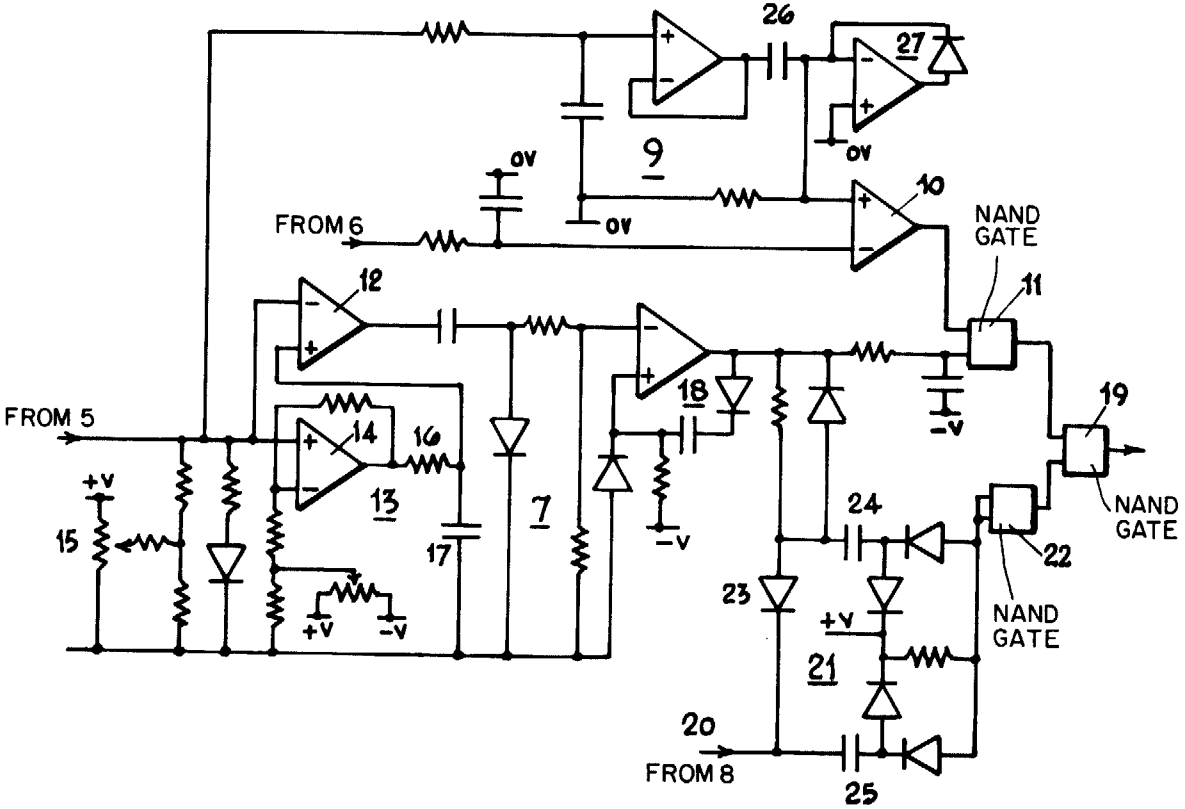
FIG. 2 shows diagrammatically a part of the system shown in FIG. 1.

The output signals from these filters 3 and 4 are envelope detected, or half-wave rectified, at 5 and 6, respectively, and the rectified signals are applied to respective circuits 7 and 8 for detecting elements in these signals which indicate a human footstep, one of these circuits being shown diagrammatically in FIG. 2. An alarm indication derived from such signal elements is derived in a circuit 34, which is shown in detail in FIGS. 2 and 3, and is passed to an alarm 35, which may provide a visual and/or audible warning of an intruder.

The rectified signals comprise in general a succession of short, irregular positive-going, voltage pulses or "spikes" representing a background of vibrations incident upon the transducers 1, each spike made up of or extending over, say, a few half-cycles of the selected frequencies. Rectified signals including components originating from a footstep within range of the transducers 1 have superimposed on this background a pulse signal having a steep leading edge and a duration typically of the order of thirty to one hundred milliseconds. Within a limited range of any one transducer or group of transducers 1 such a pulse signal will be detectable both in respect of the lower frequency band and the upper frequency band, although in general due to dispersion and different attenuation the pulse in the upper frequency band will occur earlier and be of lower amplitude than that in the lower frequency band.

Referring now to FIG. 2 the two rectified signals are also applied to a comparator circuit 9 where the signals are integrated, in respective RC networks having time-constants of some twenty milliseconds, to provide short-term voltage-time integrals for comparison of the energy content of the signals at the higher and lower frequencies. It has been found that for human footsteps the energy content at the lower frequency is the greater, and in dependence upon which is the greater a differential amplifier 10 is arranged to apply different potentials to a NAND gate 11.

The one hundred Hertz detector circuit 7, as shown in FIG. 2, comprises a differential amplifier 12 to the inverting input of which the rectified higher frequency signal is applied directly and to the non-inverting input of which is applied the output of a waveform shaping circuit 13. The circuit 13 comprises a differential amplifier 14 whose gain is reduced to approximately three by negative feedback. At the output of this amplifier 14 the rectified signal appears superimposed on a preset voltage bias level derived from a potentiometer 15, the composite signal being applied to the amplifier 12 by way of an integrating circuit comprising a resistor 16 and a capacitor 17. This integrating circuit has a time-constant of the order of forty milliseconds, that is, several times as long as the rise time of any significant component of the rectified signal, so that a rise in voltage at the leading edge of any pulse in the composite signal is slowed down before that pulse is applied to the amplifier 12. Because of the preset bias and the gain of the amplifier 14 the composite signal applied to the non-inverting input of the amplifier 12 is normally of greater magnitude than the original rectified signal at the inverting input of that amplifier. When a pulse signal occurs, however, which is such that the rectified voltage waveform rises quickly for more than a predetermined time this waveform overtakes the slower rise of the composite waveform and the output of the amplifier 12 changes polarity. This change of polarity applies a negative-going transient to trigger a monostable circuit 18, which is arranged to restore from its set condition to its normal condition in a period of the order of half a second. The corresponding monostable circuit in the thirty three Hertz detector circuit 8 is arranged to restore some four times more quickly.

When signals arising from a human footstep within range of the transducers 1 are incident upon the transducers 1 the comparison of energy levels in the two frequency bands results in a logic "zero" or negative voltage level being applied from the output of the amplifier 10 to the gate 11, so that a logic "one" is applied to one input of a second NAND gate 19. In general the event will result in the output of positive pulses from the detector circuits 7 and 8, the pulse from the detector 8, applied to a path 20, generally commencing earlier but lasting longer than the pulse from the detector 7.

When a positive pulse is produced by the monostable circuit 18 in the detector 7 alone, a diode 23 connected to the path 20 holds a capacitor 24 in the network 21 charged to a negative potential, and the termination of such a pulse has substantially no effect on a NAND gate 22. If a positive pulse is produced on the path 20, from the detector circuit 8, a capacitor 25 is discharged, while if a pulse occurs on the path 20 while a pulse from the detector circuit 7 is present both the capacitors 24 and 25 are discharged. The subsequent negative-going transient transmitted by one or the other of these capacitors 24 and 25 as the respective pulse terminates and the respective capacitor commences to recharge is applied to the input of the gate 22, which acts as an inverter to apply a logic "one" to the gate 19. With logic "ones" at both inputs the gate 19 provides a logic "zero" output to indicate a valid "event". Thus, so long as the comparison of energy levels indicates greater energy at thirty three Hertz a footstep-like signal detected by the circuit 8 alone, or by both detectors 7 and 8, will be treated as a valid "event". An alarm indication may be given if such "events" occur at a repetition rate within a predetermined range, as determined by subsequent logic circuits, shown in FIG. 3.

Figure 3:
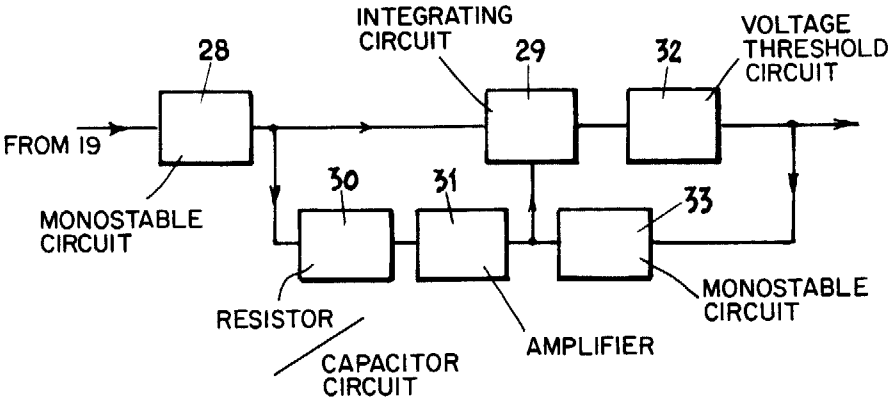
FIG. 3 shows schematically another part of the system shown in FIG. 1.

Referring now to FIG. 3, the logic circuits include a monostable circuit 28 which is arranged to provide a standard output pulse of some three hundred milliseconds duration for each valid "event", an integrating circuit 29 arranged to integrate these standard pulses, a resettable resistor-capacitor circuit 30 which is arranged to enable a slow-discharge path by way of an amplifier 31 for the integrating circuit 29 after an interval of, say, three seconds from the last said standard pulse, a voltage threshold circuit 32 to give said alarm indication if the output of the integrating circuit 29 exceeds a given level, and a monostable circuit 33 for completing a rapid-discharge path for the integrating circuit 29 in the event of an alarm indication being given.

If there is a background of vibration "noise" having a significant component at high frequencies, such as may be caused by an aircraft passing overhead, the substantially constant high level integral from the one hundred Hertz rectified signal is blocked by a capacitor 26 in the circuit 9, and the signal passing to the righthand side of that capacitor, as drawn in FIG. 2, is D.C. restored by a circuit 27 such that shorter term integrals from, say, footsteps appear as positive-going signals starting substantially from zero volts.

Figure 4:
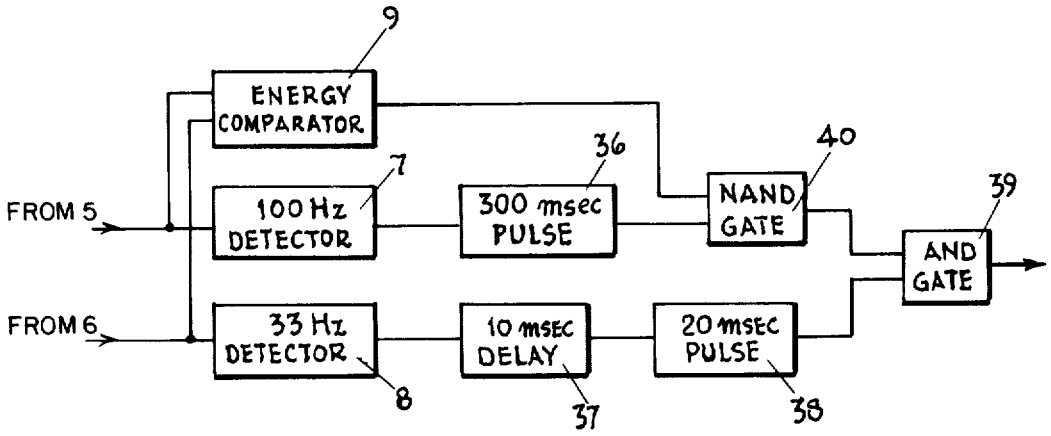
FIG. 4 shows an alternative form of part of the system shown in FIG. 1.

Referring now to FIG. 4 an alternative arrangement for validating "events" comprises three monostable circuits 36, 37 and 38 and an AND gate 39. The monostable circuit 36 serves to stretch the pulse from the detector circuit 7 to a length of some three hundred milliseconds, while the monstable circuit 37 delays the pulse from the detector circuit 8, to ensure that it falls within any substantially coincident stretched pulse from the monostable circuit 36, and the monostable circuit 38 stretches the output pulse of the monostable circuit 37 to a length of some twenty milliseconds. A NAND gate 40 is connected between the monostable circuit 36 and the gate 39, this NAND gate 40 receiving a logic "one" from the energy comparison circuit 9 if the energy content of received signals is higher in the one hundred Hertz band than in the thirty three Hertz band. The inputs to the gate 40 have the effect of closing the gate 39, that is of preventing the passage of "event" pulses from the detector 8 by way of the gate 39 to an "event" counter in the circuit 34, if an "event" is detected by the one hundred Hertz "event" detector 7 while the comparison of energy levels by the circuit 9 shows greater energy in the one hundred Hertz band than in the thirty three Hertz band. The arrangement therefore treats as valid only "events" in the thirty three Hertz band alone or "events" in both bands with higher energy in the lower band.

In some situations it may be sufficient simply to accept as valid those "events" that occur in the thirty three Hertz band alone and to reject those that occur in both the thirty three Hertz and the one hundred Hertz bands substantially simultaneously. In such circumstances the energy level comparator circuit 9 is not required and this circuit and the gate 40 may be omitted. An inverted output is then required from the monostable circuit 36 as the respective input to the gate 39, so as to apply a logic "zero" to that input throughout the period of the three hundred millisecond pulse marking an "event" in the one hundred Hertz band.

The logic circuits shown in FIG. 3 may be replaced by an up-down counter providing similar delay and count-down periods, the counter being preset to give an alarm in response to, say, from two to eight events within a predetermined period, according to terrain and the sensitivity required.

We claim:

1. An intruder alarm system comprising at least one electromechanical transducer that provides electric signals in response to vibrations incident thereon, which electric signals may extend over a range of frequencies, first and second bandpass filter means to pass components if said electric signals in respective bands of frequencies within said range, respective means to rectify said signal components to provide first and second electric waveforms, first and second detector circuit means each arranged to give an output signal if a respective one of said electric waveforms exceeds a respective reference signal by more than a predetermined amount, and gating means selectively to pass an output signal from said first detector circuit means to alarm indicating means in dependence upon an output signal from said second detector circuit means.

2. An intruder alarm system in accordance with claim 1 wherein the occurrence of an output signal from the second detector circuit means prevents said gating means from passing the output signal from said first detector means.

3. An intruder alarm system in accordance with claim 1 wherein each said reference signal is derived from and tends to follow the magnitude of the respective one of said first and second waveforms but with slowed rise times.

4. An intruder alarm system in accordance with claim 1 wherein there are provided a monostable circuit arrangement to provide a pulse signal in response to each output signal from said gating means, integrating circuit means to which said pulse signals are applied, and means to give an alarm indication if an output voltage level of said integrating circuit means exceeds a predetermined level.

5. An intruder alarm system in accordance with claim 4 wherein there are provided means to initiate a slow restoration of said integrating circuit means if any one of said pulse signals is not followed by another within a predetermined period.

6. An intruder alarm system in accordance with claim 1 wherein there are provided means to compare time integrals of said first and second waveforms, and said gating means is arranged selectively to pass the output signal from said first detector circuit means in dependence upon the output of said comparator means and the output signal of said second detector circuit means.

7. An intruder alarm system comprising at least one electromechanical transducer that provides electric signals in response to vibrations incident upon said transducer, which electric signals may extend over a range of frequencies, first and second bandpass filter means to pass components of said electric signals in respective bands of frequencies within said range, respective means to rectify said signal components to provide first and second electric waveforms, detector circuit means to give an output signal if a respective one of said electric waveforms exceeds a respective reference signal by more than a predetermined amount, comparator means to compare time integrals of said first and second waveforms, and gating means selectively to pass the output signal from said detector circuit means in dependence upon an output from said comparator means.

* * * * *